US008092554B2

(12) United States Patent
Jassal

(10) Patent No.: US 8,092,554 B2
(45) Date of Patent: Jan. 10, 2012

(54) DISCHARGE PRINT PASTE FORMULATION FOR NATURAL AND SYNTHETIC FABRIC AND METHOD OF USING SAME

(76) Inventor: Devpreet Jassal, Bolton (CA)

( * ) Notice: Subject to any disclaimer, the term of this patent is extended or adjusted under 35 U.S.C. 154(b) by 690 days.

(21) Appl. No.: 11/514,863

(22) Filed: Sep. 5, 2006

(65) Prior Publication Data

US 2007/0294840 A1 Dec. 27, 2007

Related U.S. Application Data

(60) Provisional application No. 60/786,737, filed on Mar. 29, 2006.

(51) Int. Cl.
*D06P 5/15* (2006.01)
*D06M 15/643* (2006.01)

(52) U.S. Cl. ..... 8/457; 8/114; 8/115; 8/458; 252/8.61

(58) Field of Classification Search ..... 8/102, 107, 8/108.1, 110, 111, 114, 115, 457, 458; 252/8.61
See application file for complete search history.

(56) References Cited

U.S. PATENT DOCUMENTS 4,631,067 A * 12/1986 Hussamy ..... 8/464
5,131,915 A * 7/1992 Mendoza ..... 8/457
5,558,676 A * 9/1996 Gray et al. ..... 8/107
5,593,458 A * 1/1997 Dickson et al. ..... 8/102
5,639,281 A * 6/1997 Hopkins ..... 8/115.6
6,287,346 B1 * 9/2001 Ofosu-Asante et al. ..... 8/103
2004/0261196 A1 * 12/2004 Ghosh et al. ..... 8/147
2006/0277689 A1 * 12/2006 Hubig et al. ..... 8/115.51

OTHER PUBLICATIONS

Rockwood Additives Limited: A Rockwood Specialties Group, Inc. Company, http://www.laponite.com/. 2006 Rockweeod Specialties, Inc.*

Laponite Brochure from Rockwood Additives found at http://www.scprod.com/pdfs/Laponite%20brochure%20EN.pdf.

* cited by examiner

*Primary Examiner* — Mark Kopec
*Assistant Examiner* — Bijan Ahvazi
(74) *Attorney, Agent, or Firm* — McAndrews, Held & Malloy Ltd.

(57) ABSTRACT

The discharge print paste formulation contains synthetic layered silicate as a carrier and thickening agent, one or more bleaching agents selected from sodium hypochlorite and hydrogen peroxide, water and optionally sodium hydroxide and discharges color when applied to washable color fast natural fabric (cotton, linen) or washable synthetic and permanent press fabric. The discharge print paste formulation is applied to the fabric. The treated fabric is dried at room temperature, washed and dried to get a pattern of discharged color where the discharge print paste formulation is applied.

6 Claims, 4 Drawing Sheets

FIGURE 2

Sample A

Original Sample A

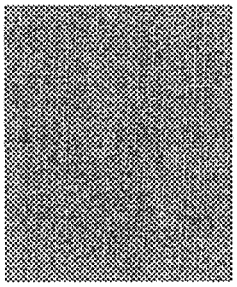

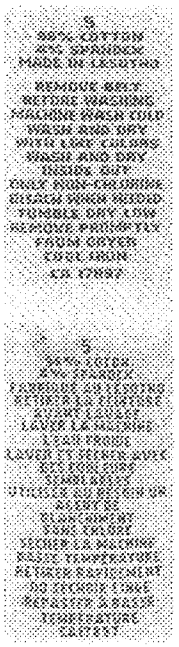

corresponds to PANTONE Cool Gray 11 C

Discharged Sample A1

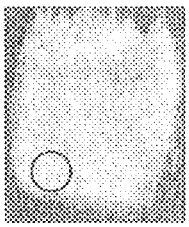

corresponds to PANTONE Cool Gray 1 C

Discharged Sample A2

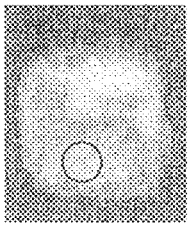

corresponds to PANTONE Cool Gray 3 C

Discharged Sample A3

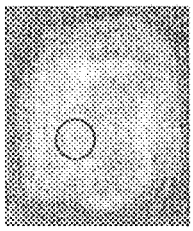

corresponds to PANTONE Cool Gray 4 C

Discharged Sample A4

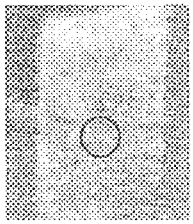

corresponds to PANTONE Cool Gray 5 C

Discharged Sample A5

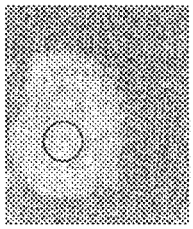

corresponds to PANTONE Cool Gray 6 C

Discharged Sample A6

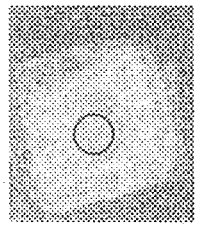

corresponds to PANTONE Cool Gray 7C

FIGURE 3
Sample B
Original Sample B
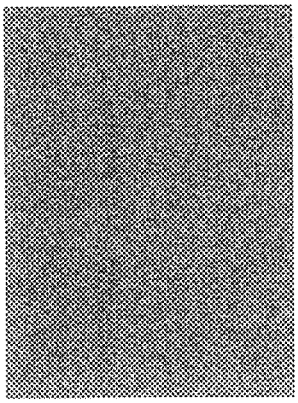
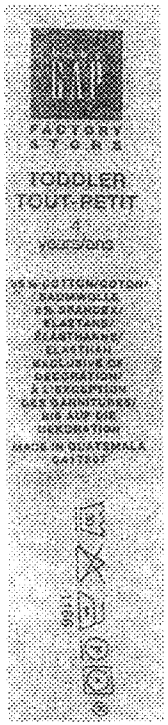
corresponds to PANTONE Cool Gray 11 C
Discharged Sample B1
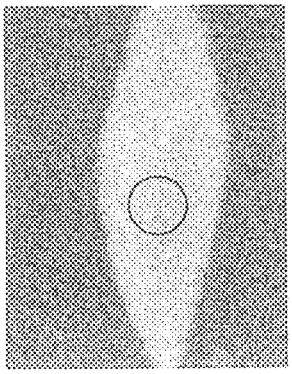
corresponds to PANTONE Cool Gray 3 C
Discharged Sample B2
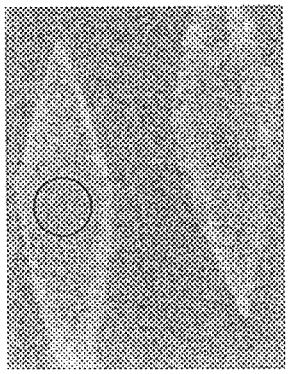
corresponds to PANTONE Cool Gray 9 C
Discharged Sample B3
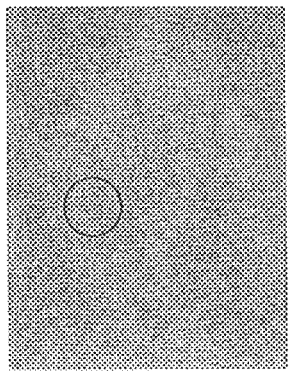
corresponds to PANTONE Cool Gray 10 C FIGURE 4
Sample C
Original Sample C
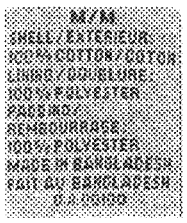
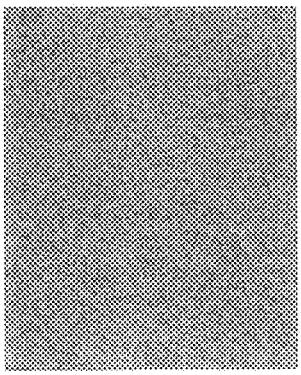
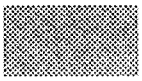
corresponds to
PANTONE
Cool Gray 10C
Discharged Sample C1
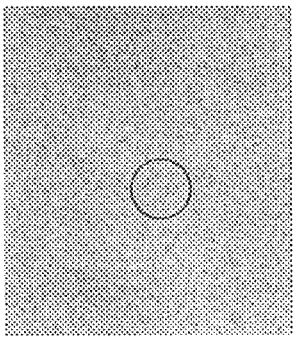
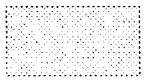
corresponds to
PANTONE
Cool Gray 5 C
Discharged Sample C2
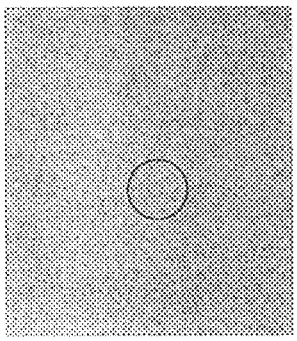
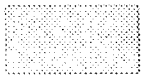
corresponds to
PANTONE
Cool Gray 7 C
Discharged Sample C3
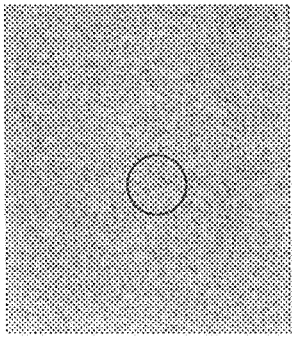
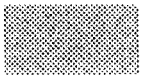
corresponds to
PANTONE
Cool Gray 10 C

DISCHARGE PRINT PASTE FORMULATION FOR NATURAL AND SYNTHETIC FABRIC AND METHOD OF USING SAME

CROSS REFERENCE TO RELATED APPLICATIONS

This application is a continuation-in-part of U.S. application Ser. No. 60/786,737 filed Mar. 29, 2006, which is pending.

FIELD OF THE INVENTION

The present invention is directed to a discharge print paste formulation which discharges color when applied to washable fabric and a method of using the formulation for discharge printing, and in particular to a discharge print paste formulation which utilizes a synthetic layered silicate as a carrier and thickening agent.

BACKGROUND OF THE INVENTION

Discharge printing is a common practice in print making on a dyed fabric. A discharge print paste is applied, in pattern form, to the dyed fabric. The paste pattern is subjected to high temperature steaming which causes the discharge print paste to discolor the dyed fabric to form a white or light colored pattern.

Traditionally a discharge paste is formulated with a combination of compounds such as sodium hydroxide, ethoxylated product and polyols, ethanedoic acid, hydroxyacetic acid, prooanoic acid, botanic acid, polyethylene glycol, polyoxyethylene sorbitan, polyalkaline glycol ether, stannous chloride etc. The discharge print paste is applied to the fabric using screen print, block print, stencil print or any other printing available for paste, for example as disclosed in U.S. Pat. Nos. 4,631,067 and 5,131,915, the contents of which are incorporated herein by reference. However, the discharge print paste, especially of U.S. Pat. No. 5,131,915, requires the use of many components including ethoxylated products, polyols, reducing agents, organic acids, thickening agents and lithium hydroxide. Such a formulation presents problems in handling and disposal of the residue after the printing.

There thus remains a need for a discharge print paste which is environmentally friendly and is simpler to formulate and use.

SUMMARY OF THE INVENTION

The present invention is directed to a discharge print paste formulation, and a method of using same, which removes the coloration from an existing dyed fabric. After application of the paste to the fabric, the fabric is allowed to dry at room temperature preferably at a temperature of about 20 deg. C. with relative humidity preferably above about 50%. Once dry, the fabric is rinsed and dried to reveal the discharge pattern. Some discharge print paste formulations in accordance with the invention may, after application to the fabric, advantageously be subjected to heat at about 96 deg. C. for a fixed time using saturated steam. This is followed by drying at room temperature preferably at a temperature of about 20 deg. C. with relative humidity preferably above about 50%.

The discharge print paste formulation of the present invention comprises synthetic layered silicate as a carrier and thickening agent, one or more bleaching agents selected from sodium hypochlorite (NaOCl) and hydrogen peroxide ($H_2O_2$), and optionally sodium hydroxide (NaOH).

In an aspect of the invention, the discharge print paste formulation comprises 10 to 30 wt % synthetic layered silicate as a carrier and thickening agent, 1 to 20 wt % of a bleaching agent selected from sodium hypochlorite (NaOCl) and hydrogen peroxide ($H_2O_2$), 47 to 89 wt % and 0 to 3 wt % sodium hydroxide (NaOH).

In another aspect of the invention, the synthetic layered silicate preferably has a composition of 59.5% silicon dioxide ($SiO_2$), 27.5% magnesium oxide (MgO), 0.8% lithium oxide ($Li_2O$) and 2.8% sodium oxide ($Na_2O$).

In yet another aspect of the invention, the discharge print paste formulation contains 16 to 26 wt % synthetic layered silicate as a carrier and thickening agent, 2 to 14 wt % of a bleaching agent, 65 to 80 wt % water and 0 to 1 wt % sodium hydroxide.

BRIEF DESCRIPTION OF THE DRAWINGS

Preferred embodiments of the present invention are illustrated in attached drawings in which:

FIG. 2 illustrates the results of a first test of a preferred embodiment of a print paste formulation of the present invention;

FIG. 3 illustrates a second test of the print paste formulation of the present invention; and FIG. 4 illustrates a third test of the print paste formulation of the present invention.

DETAILED DESCRIPTION OF THE PREFERRED EMBODIMENTS

Figure 1:
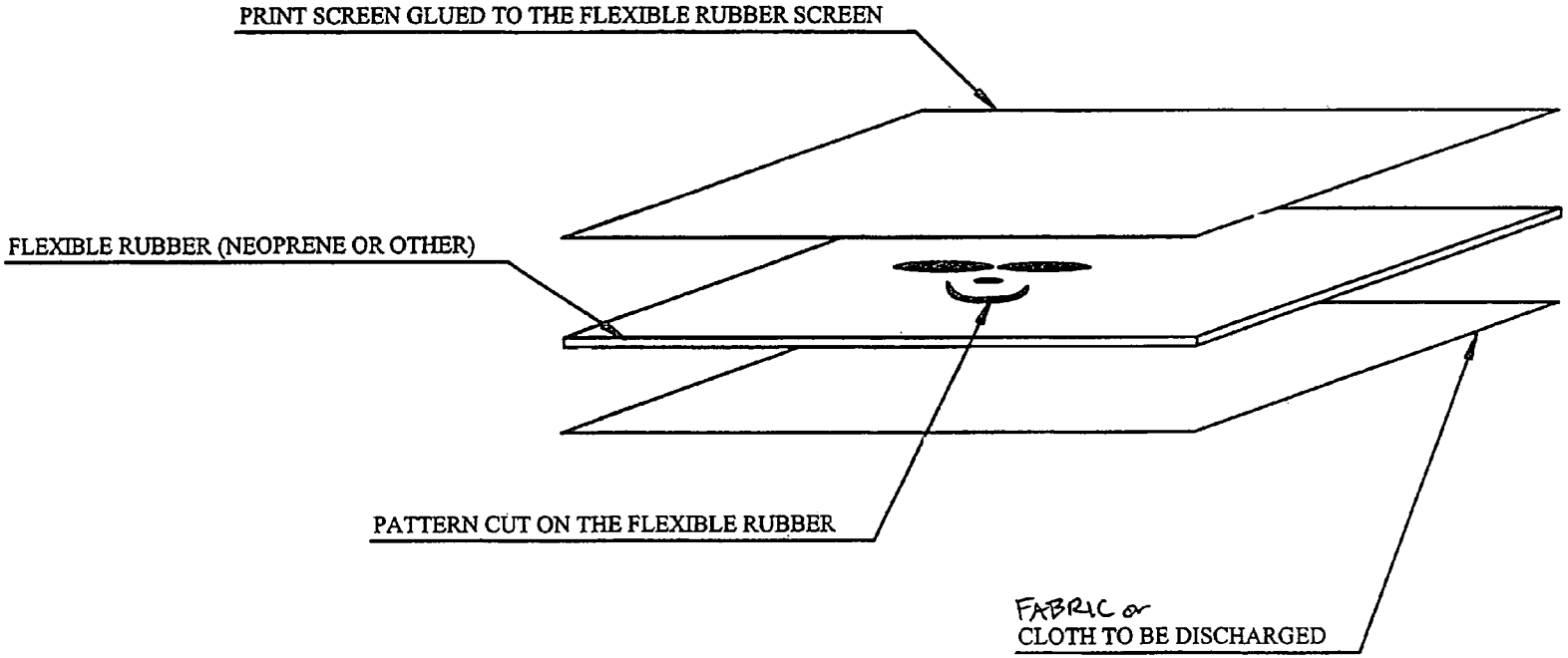
FIG. 1 is an illustration of a preferred method of application of the discharge print paste of the present invention.

The present invention is directed to a discharge paste, and a method of using same, which would remove the coloration from an existing dyed fabric. After application of the paste to the fabric, the fabric is allowed to dry at room temperature preferably at a temperature of about 20 deg. C. with relative humidity preferably above about 50%. Once dry, the fabric is rinsed and dried to reveal the discharge pattern. Some paste formulations in accordance with the invention may, after application to the fabric, advantageously be subjected to heat at about 96 deg. C. for a fixed time using saturated steam. This is followed by drying at room temperature preferably at a temperature of about 20 deg. C. with relative humidity preferably above about 50%.

The discharge paste works on natural and synthetic fabric and has been tested on cotton and polyester fabric.

The discharge print paste formulation according to the present invention contains synthetic layered silicate as a carrier and thickening agent, one or more bleaching agents selected from sodium hypo-chlorite (NaOCl) and hydrogen peroxide ($H_2O_2$), water and optionally sodium hydroxide (NaOH).

In the formulation referred to hereinafter, all formulations are by weight percent.

The preferred embodiments of the discharge print paste formulation according to the present invention contains 10 to 30 wt % of the synthetic layered silicate as a carrier and thickening agent, more preferably 16 to 26 wt % synthetic layered silicate, most preferably 18 to 26 wt % synthetic layered silicate.

The synthetic layered silicate is utilized as a carrier and thickening agent and preferably has a composition of 59.5% silicon dioxide ($SiO_2$), 27.5% magnesium oxide (MgO), 0.8% lithium oxide ($Li_2O$) and 2.8% sodium oxide ($Na_2O$). The most preferred synthetic layered silicates are those commercially available and sold as Laponite RD, Laponite XLG etc. The Laponites are synthetic layered silicates that have a structure and composition similar to smectite mineral hectorite, which has the chemical formula $Na_3(MgLi)_3Si_4O_{10}(OH)_2$. The synthetic layered silicate has the advantage over the naturally occurring hectorite in purity. If desired, the synthetic layered silicate may be doped with other compounds to enhance its properties.

The Laponite has a distinctive property. The primary platelet (building blocks of the smectite mineral crystal) size of Laponite is only 25 nm across by 1 nm thick, which is significantly smaller than the naturally occurring smectite mineral hectorite. This distinct nano-size allows Laponite to form clear gels and films.

While the use of the synthetic layered silicates on their own provide for a formulation which is able to be easily applied to the fabric, there may be circumstances where a formulation of a different viscosity or texture is desired. In these situations, small amounts of one or more of lithium hydroxide (LiOH) and magnesium hydroxide (MgOH) to change the thickness and texture of the discharge print paste may be added to the formulations. Generally up to 1 wt % may be added to the formulations. However, the concentration of the lithium hydroxide (LiOH) and magnesium hydroxide (MgOH) is kept to a minimum so that the discharge print paste formulation remains environmentally friendly.

The discharge print paste formulation contains 1 to 20 wt % of a bleaching agent selected from sodium hypochlorite and hydrogen peroxide. Preferably, the discharge print paste formulation contains 2 to 14 wt % of a bleaching agent. When utilizing sodium hypochlorite as the bleaching agent, the formulation more preferably contains 2 to 8 wt % of sodium hypochlorite, most preferably about 5 to 8 wt % sodium hypochlorite. When utilizing hydrogen peroxide as the bleaching agent, the formulation preferably contains about 10 to 14 wt % of hydrogen peroxide, most preferably about 14 wt % hydrogen peroxide. Formulations utilizing hydrogen peroxide as the bleaching agent may also contain up to 3 wt % sodium hydroxide, most preferably about 1 wt % sodium hydroxide. The balance of the formulation is water.

While any source of water may be used, it has been found that regular domestic tap water from a municipal water source works well. Such water contains some electrolytes which does not interfere with the function of the formulation and may enhance the formation of the formulation. In addition, the use of such a water source adds the benefit of allowing for more economical production of the formulations as no special handling of the water is required.

The discharge print paste formulations of the present invention preferably do not contain any detergent or softening agents. The paste formed by the above mixture is applied on dyed fabric. The preferred application methods are modified screen printing (as described below) or direct application with a spatula. Some paste formulations in accordance with the invention may, after application to the fabric, advantageously be subjected to heat at about 96 deg. C. for a fixed time using saturated steam. Generally, the time for heat treatment will be on the order of 15 to 90 minutes, preferably about 60 minutes. The applied paste is dried at room temperature preferably at a temperature of about 2° C. with preferably above about 50% relative humidity. The fabric is rinsed, washed and dried in a washing machine suitable for the fabric and dried.

APPLICATION METHOD

The application of the paste on the fabric may be done by a modified screen printing process. A pattern is cut on a flexible rubber or plastic sheet and glued on to a screen as shown in FIG. 1. While printing a pattern on fabric, the screen remains on the top and rubber or plastic sheet sits on the fabric. The paste is applied by squeegee on the screen and the paste passes through the screen in the shape of the pattern. The thickness of the rubber sheet and the thickness of the screen determines the thickness of the paste transferred on to the fabric. The greater the thickness of the rubber sheet or screen, the thicker the layer of the paste transferred on to the fabric. A thicker paste layer discharges more color from the fabric. In the example described below, rubber or plastic thickness of 1 mm and 2 mm and screen thickness of 0.1 mm were used.

Examples

Test 1

The test 1 was designed to study the effect of various concentrations of the discharge paste on the same sample of fabric. The results of this test are shown in FIG. 2.

The fabric sample "A", made of 96% cotton and 4% spandex woven in denim weave, was discharged with various formulations. The original sample and the discharged samples were scanned in a black and white format to compare the effect of the discharge paste. The samples were compared using Adobe Photoshop PANTONE Gray scale. Due to variation in the discharge patterns, the sections marked by circles were compared to the original sample.

Sample A1 was discharged with a paste formulation containing 25.64% synthetic layered silicate (Laponite RD), 7.69% sodium hypo-chlorite (NaOCl) and 66.67% tap water. On Adobe Photo Shop PANTONE scale the original sample compared to Cool Gray 11C and the discharged sample compared to Cool Gray 1C. The discharged sample was 10 shades lighter than the original sample.

Sample A2 was discharged with a paste formulation containing 18.03% synthetic layered silicate (Laponite RD), 6.15% sodium hypo-chlorite (NaOCl) and 75.82% tap water. On Adobe Photo Shop PANTONE scale the original sample compared to Cool Gray 11C and the discharged sample compared to Cool Gray 3C. The discharged sample was 8 shades lighter than the original sample.

Sample A3 was discharged with a paste formulation containing 19.64% synthetic layered silicate (Laponite RD), 5.58% sodium hypo-chlorite (NaOCl) and 74.78% tap water. On Adobe Photo Shop PANTONE scale the original sample compared to Cool Gray 11C and the discharged sample compared to Cool Gray 4C. The discharged sample was 7 shades lighter than the original sample.

Sample A4 was discharged with a paste formulation containing 20% synthetic layered silicate (Laponite RD), 5% sodium hypo-chlorite (NaOCl) and 75% tap water. On Adobe Photo Shop PANTONE scale the original sample compared to Cool Gray 11C. and the discharged sample compared to Cool Gray 5C. The discharged sample was 6 shades lighter than the original sample.

Sample A5 was discharged with a paste formulation containing 16.67% synthetic layered silicate (Laponite RD), 4.17% sodium hypo-chlorite (NaOCl) and 79.17% tap water. On Adobe Photo Shop PANTONE scale the original sample compared to Cool Gray 11C and the discharged sample compared to Cool Gray 6C. The discharged sample was 5 shades lighter than the original sample.

Sample A6 was discharged with a paste formulation containing 20% synthetic layered silicate (Laponite RD), 2.20% sodium hypo-chlorite (NaOCl) and 77.80% tap water. On Adobe Photo Shop PANTONE scale the original sample compared to Cool Gray 11C and the discharged sample compared to Cool Gray 7C. The discharged sample was 4 shades lighter than the original sample.

Test 2

Test 2 was designed to study the effect of various thicknesses of discharge paste on the same sample of fabric. The thickness of the discharge paste was adjusted according to the thickness of the rubber/plastic sheet used as discussed above. For this test, 1 mm and 2 mm rubber sheet was used. The same pattern was cut in the two pieces of rubber and a screen was glued to the rubber sheet. Paste with same formulation was applied to the two screens. The results of this test are shown in FIG. 3.

The fabric sample "B", made of 96% cotton and 4% spandex woven in knit weave, was used for discharging. The original sample and the discharged samples were scanned in a black and white format to compare the effect of the discharge paste. The samples were compared with Adobe Photoshop PANTONE Gray scale. Due to variation in the discharge patterns, the sections marked by circles were compared to the original sample.

Sample B1 was discharged with a paste formulation containing 20% synthetic layered silicate (Laponite RD), 5% sodium hypo-chlorite (NaOCl) and 75% tap water using 2 mm thick rubber sheet. On Adobe Photo Shop PANTONE scale the original sample compared to Cool Gray 11C and the discharged sample compared to Cool Gray 3C. The discharged sample was 8 shades lighter than the original sample.

Sample B2 was discharged with a paste formulation the same as for B1, namely, containing 20% synthetic layered silicate (Limonite RD), 5% sodium hypo-chlorite (Nalco) and 75% tap water using 1 mm thick rubber sheet. On Adobe Photo Shop PANTONE scale the original sample compared to Cool Gray 11C and the discharged sample compared to Cool Gray 9C. The discharged sample was 2 shades lighter than the original sample.

Test 3

Test 3 was designed to study the effect of using hydrogen peroxide instead of sodium hypochlorite as a bleaching agent. The results of this test are shown in FIG. 4.

Sample B3 was discharged with a paste formulation containing 19.80% synthetic layered silicate (Laponite RD), 13.85 hydrogen peroxide ($H_2O_2$), 65.35% tap water and 1% sodium hydroxide (NaOH). The sample was heated to 96 C using saturated steam. The heated sample was dried at room temperature 20 deg. C. and relative humidity above 50%. On Adobe Photo Shop PANTONE scale the original sample compared to Cool Gray 11C and the discharged sample compared to Cool Gray 10C. The discharged sample was 1 shade lighter than the original sample.

Test 4

The fabric sample "C", made of 100% polyester (plain weave) lining material, was discharged with various formulations made with hydrogen peroxide or sodium hypo-chlorite as a bleaching agent. The original sample and the discharged sample was scanned in a black and white format to compare the effects of the discharge pastes. The samples were compared with Adobe Photoshop PANTONE Gray scale. Due to variation in the discharge pattern, the section marked by circles were compared to the original sample. The results of this test are shown in FIG. 5.

Sample C1 was discharged with a paste formulation containing 25.64% synthetic layered silicate (Laponite RD), 7.69% sodium hypo-chlorite (NaOCl) and 66.67% tap water. On Adobe Photo Shop PANTONE scale the original sample compared to Cool Gray 10C and the discharged sample compared to Cool Gray 5C. The discharged sample was 5 shades lighter than the original sample.

Sample C2 was discharged with a paste formulation containing 20% synthetic layered silicate (Laponite RD), 5% sodium hypo-chlorite (NaOCl) and 75% tap water. On Adobe Photo Shop PANTONE scale the original sample compared to Cool Gray 10C and the discharged sample compared to Cool Gray 7C. The discharged sample was 3 shades lighter than the original sample.

Sample C3 was discharged with a paste formulation containing 19.80% synthetic layered silicate (Laponite RD), 13.85 hydrogen peroxide ($H_2O_2$), 65.35% tap water and 1% sodium hydroxide (NaOH). The sample was heated to 60 C using saturated steam. On Adobe Photo Shop PANTONE scale the original sample compared to Cool Gray 10C and the discharged sample compared to Cool Gray 10C. The discharged sample was the same shade as the original sample.

The discharge print paste formulations of the present invention are more environmentally friendly and simpler to formulate and use than those of the prior art. The discharge print past formulations of the present invention work on the surface of the dyed fabric to remove the dye from the surface fibers. As the formulation does not penetrate very far below the surface, the treated fibers retain the feel of the untreated fibers, thus lending a more natural feel and appearance to the treated material.

Although various preferred embodiments of the present invention have been described herein in detail, it will be appreciated by those of skill in the art that variations may be made thereto without departing from the spirit of the invention or the scope of the appended claims.

The invention claimed is:

1. A discharge print paste formulation consisting essentially of a mixture of about 10 to about 30 wt % synthetic layered silicate as both a carrier and thickening agent; about 1 to about 20 wt % of one or more bleaching agents selected from the group consisting of sodium hypochlorite and hydrogen peroxide; water and optionally sodium hydroxide; and wherein the synthetic layered silicate comprises 59.5% silicon dioxide ($SiO_2$), 27.5% magnesium oxide (MgO), 0.8% lithium oxide ($Li_2O$) and 2.8% sodium oxide ($Na_2O$).

2. A discharge print paste formulation according to claim 1 wherein the one or more bleaching agent is sodium hypochlorite present at a concentration of 4 to 8 wt %.

3. A discharge print paste formulation according to claim 1 wherein the one or more bleaching agent is hydrogen peroxide present at a concentration of 10 to 14 wt %.

4. A discharge print paste formulation according to claim 1 comprising 16 to 26 wt % synthetic layered silicate, 2 to 14 wt % of a bleaching agent, 57 to 82 wt % water and 0 to 3 wt % sodium hydroxide.

5. A discharge print paste formulation according to claim 1 comprising 18 to 26 wt % synthetic layered silicate, 2 to 14 wt % of a bleaching agent, 59 to 80 wt % water and 0 to 1 wt % sodium hydroxide.

6. A method of discharge printing of a fabric comprising applying a discharge print paste formulation to a dyed fabric, wherein the discharge print paste formulation consisting essentially of a mixture of about 10 to about 30 wt % synthetic layered silicate as both a carrier and thickening agent; about 1 to about 20 wt % of one or more bleaching agents selected from the group consisting of sodium hypochlorite and hydrogen peroxide; water and optionally sodium hydroxide; and wherein the synthetic layered silicate comprises 59.5% silicon dioxide ($SiO_2$), 27.5% magnesium oxide (MgO), 0.8% lithium oxide ($Li_2O$) and 2.8% sodium oxide ($Na_2O$), drying the treated fabric at room temperature, followed by washing and drying the fabric.

* * * * *